US006390150B2

(12) United States Patent
Reinecke

(10) Patent No.: US 6,390,150 B2
(45) Date of Patent: May 21, 2002

(54) DRIVE FOR BOTTLING MACHINE

(75) Inventor: Günter Reinecke, Solingen (DE)

(73) Assignee: Sig Hamba Fill/Tec GmbH & Co. KG, Neunkirchen/Sarr (DE)

( * ) Notice: Subject to any disclaimer, the term of this patent is extended or adjusted under 35 U.S.C. 154(b) by 0 days.

(21) Appl. No.: 09/793,725

(22) Filed: Feb. 26, 2001

(30) Foreign Application Priority Data

Feb. 25, 2000 (DE) ..... 100 09 006

(51) Int. Cl.[7] ..... B65B 43/42
(52) U.S. Cl. ..... 141/156; 141/129; 141/165
(58) Field of Search ..... 141/156, 129, 141/165, 131, 144, 163, 171, 173, 176, 180, 85, 89, 92; 198/341.02, 502.03; 414/222.02

(56) References Cited

U.S. PATENT DOCUMENTS 3,694,997 A * 10/1972 Christine et al.
3,859,774 A * 1/1975 Bausch
4,014,158 A * 3/1977 Rausing
4,409,775 A * 10/1983 Brody et al.
4,448,820 A * 5/1984 Buschor
4,497,156 A * 2/1985 Scheidegger
4,862,933 A 9/1989 Gies ..... 141/130
5,002,103 A * 3/1991 Marescalchi
5,265,655 A * 11/1993 Hirsch
5,444,368 A * 8/1995 Horber
5,477,663 A * 12/1995 Smith et al.
5,730,436 A * 3/1998 Viebach et al.
6,209,591 B1 * 4/2001 Taggart

* cited by examiner

*Primary Examiner*—Gregory L. Huson
*Assistant Examiner*—Khoa Huynh
(74) *Attorney, Agent, or Firm*—Herbert Dunbo; Andrew Wilford

(57) ABSTRACT

An apparatus for filling containers has a frame carrying a plurality of sprockets and an endless conveyor chain on the frame having between two of the sprockets a straight treatment stretch. A succession of holders secured to the chain are each formed with a transverse row of seats adapted to hold respective containers. Respective machines carried on the frame and spaced apart along the stretch clean, fill, and cap containers in the seats. A drive connected to one of the sprockets advances the chain and moves the containers in steps in the seats past the machines. A metering wheel journaled in the frame meshes near one of the machines with the chain such that as the chain is advanced the wheel is synchronously rotated. A movable sensor element synchronously movable with the wheel can orbit on rotation of the wheel past a fixed sensor element carried on the frame to generate an output. A controller connected between the movable sensor element and the drive receives the output and positions the seats with respect to the machines.

9 Claims, 2 Drawing Sheets

DRIVE FOR BOTTLING MACHINE

FIELD OF THE INVENTION

The present invention relates to a drive for a foodstuff-packaging machine. More particularly this invention concerns such a drive for a bottling machine.

BACKGROUND OF THE INVENTION

In a standard packaging or bottling machine such as described in U.S. Pat. No. 4,862,933 of B. Gies an endless conveyor is provided with a longitudinal succession of holders each forming a respective transverse row of seats for respective containers, normally bottles. The conveyor has at least one straight and horizontal stretch which passes a series of subassemblies that serve sequentially to sterilize, fill, and cap the containers. Typically the conveyor moves discontinuously, that is in steps, picking up empty bottles at an upstream end of the straight stretch, sterilizing, filling, and closing the bottles, and depositing them on an output conveyor at a downstream end of the stretch.

The standard such conveyor comprises a pair of standard roller chains spanned over sprockets at least one of which is driven at a predetermined rate by a respective drive motor. The normally discontinuous advance is carefully set with respect to the cycling time of the sterilizing, filling, and capping units so that each time the chain stops, the containers are positioned under the nozzle, sealing tool, or the like of the respective unit.

With time it is inevitable, even with an essentially inextensible metal roller chain, for there to be some offset between the desired position of a row of bottles at the starting of a sterilizing, filling, or capping cycle and its actual position. The result can be failure to properly sterilize, partial filling and spillage, and inadequate sealing of the container closure. The sealing machine must normally bring a heated or ultrasonic tool into engagement all around the mouth of the container to seal perfectly, and the fillers often have a nozzle that must fit into the mouth of the bottle. Obviously any failure of these devices requires that the batch be thrown out and the machine reset. Since the drive motor that advances the holder chain is invariably offset from the sterilizing, filling, and closing machines, wear resulting in stretch or lengthening of the chain can be enough to set holders in bad position.

OBJECTS OF THE INVENTION

It is therefore an object of the present invention to provide an improved drive for a container-filling machine.

Another object is the provision of such an improved drive for a container-filling machine which overcomes the above-given disadvantages, that is which ensures perfect synchronism between the sterilizing, filling, and/or closing units and the normally discontinuous advance of the conveyor.

SUMMARY OF THE INVENTION

An apparatus for filling containers has according to the invention a frame carrying a plurality of sprockets and an endless conveyor chain on the frame having between two of the sprockets a straight treatment stretch. A succession of holders secured to the chain are each formed with a transverse row of seats adapted to hold respective containers. Respective machines carried on the frame and spaced apart along the stretch clean, fill, and cap containers in the seats. A drive connected to one of the sprockets advances the chain and moves the containers in steps in the seats past the machines. A metering wheel journaled in the frame meshes near one of the machines with the chain such that as the chain is advanced the wheel is synchronously rotated. A movable sensor element synchronously movable with the wheel can orbit on rotation of the wheel past a fixed sensor element carried on the frame to generate an output. A controller connected between the movable sensor element and the drive receives the output and positions the seats with respect to the machines.

Thus the system of this invention determines the actual position of the holders carried by the chain right at the machine that is sterilizing, filling, or closing the containers in the holders. If the chain stretches or wears, the position is still measured right where it counts, even with the drive motor connected to the chain at a location relatively remote from the various treatment machines.

According to the invention a metering shaft journaled in the frame has one end carrying the metering wheel and another end carrying a disk on which is mounted the movable sensor element. The angular position of the movable sensor element is adjustable on the disk. In addition the movable sensor element is mounted on an outer periphery of the disk. It can be set on the disk at such an angular position that the sensor elements come into closest proximity with each other at a time when the holders are immediately upstream of a desired stopping position so that inertia of the chain is compensated for by the angular offset of the movable sensor element. The sensors are of the noncontacting type and may work magnetically, with light, or even capacitatively.

The wheel according to the invention has teeth meshing with the conveyor chain. Furthermore an effective circumference of the wheel at the teeth is equal to a longitudinal spacing between succeeding holders on the conveyor chain. Thus one revolution of the wheel exactly equals one step of the chain.

In accordance with the invention the conveyor chain has a pair of opposite edges and the described metering wheel meshes with one of the edges. The apparatus further has according to the invention a second metering wheel journaled in the frame and meshing across the conveyor from the first-mentioned metering wheel with the other edge of the chain such that as the chain is advanced the second wheel is also synchronously rotated. A second movable sensor element synchronously rotatable with the second wheel orbits on rotation of the second wheel past a second fixed element to generate an output. The controller is connected to both of the fixed sensors and measures how much time elapses between generation of the outputs by the fixed sensor elements. More particularly the controller stops the chain when the outputs of the fixed sensors are not generated within a predetermined time of each other. Thus if the conveyor chain becomes racked, that is with one edge advanced more than another, the system will be shut down, as this is indication of a serious problem.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
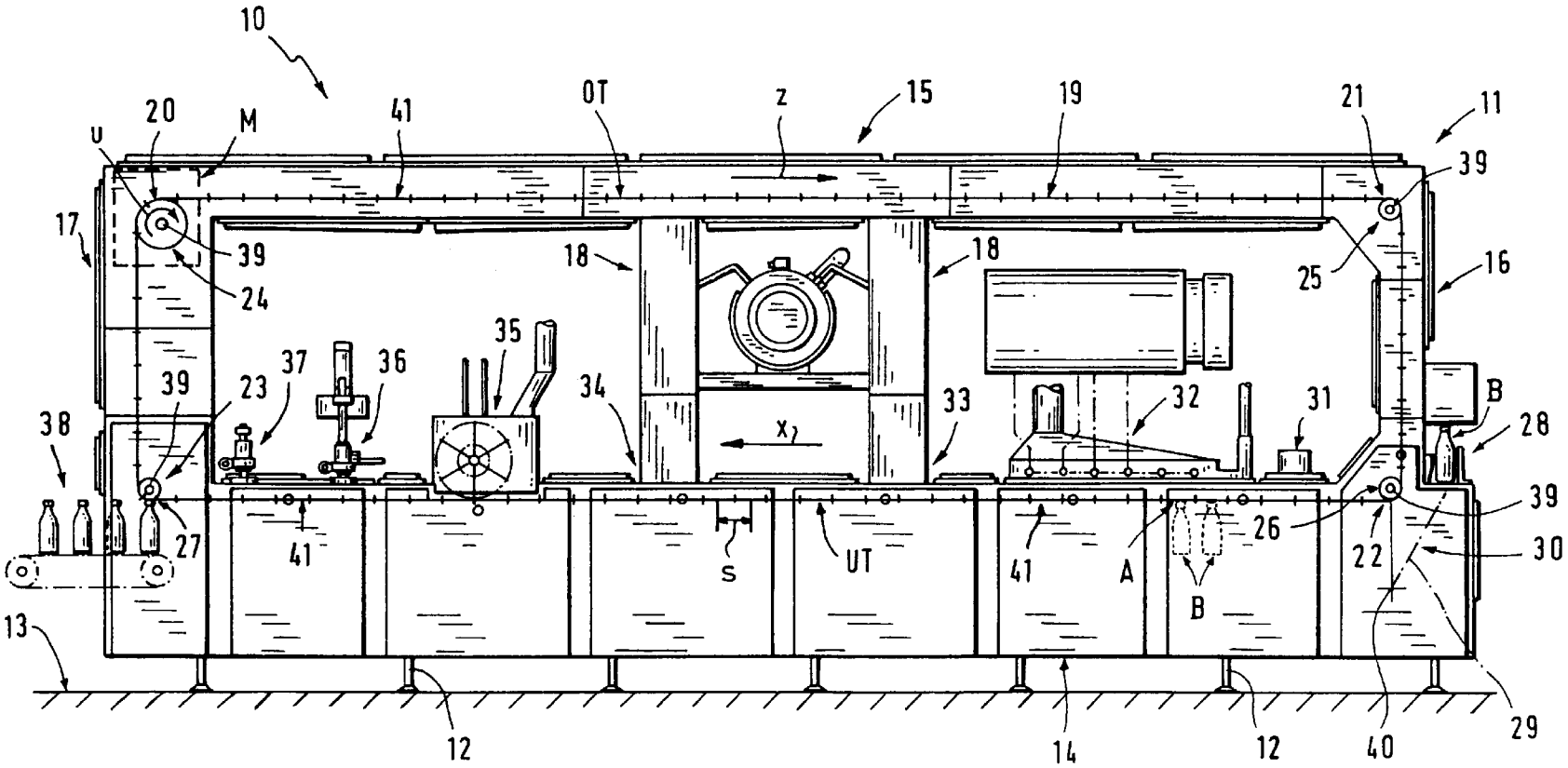
FIG. 1 is a small-scale side view of the bottling system according to the invention.

As seen in FIG. 1 a bottling system 10 in accordance with the invention has an open frame 11 supported via feet 12 on the floor or ground 13 and having a horizontally extending lower portion 14, a parallel upper portion 15, and upstream and downstream end uprights 16 and 17 connecting the ends of the portions 14 and 15. Centrally a portal-type upright 18 supports the center of the upper portion 15.

An endless conveyor element 19 passes at upper corners and 21 and lower corners 22 and 23 around respective wheels or sprockets 24, 25, 26, and 27 carried on respective axles 39 and driven by a variable-speed servomotor motor M to rotate in a direction u (see corner 20) so that a straight and horizontal lower conveyor stretch UT moves in the lower frame portion 14 in a transport direction x and an upper straight and horizontal stretch TO moves oppositely in the upper portion 15 in a direction z. The conveyor 19 is formed by a pair of parallel endless roller chains 54 bridged by a succession of two-part holders 41. An intake station 28 at the lower upstream corner 22 has a loader 29 having a pivotal bottle holder 30 that fits PET containers or bottles B to the conveyor 19, whence they are moved in the transport direction x through a sensor station 31 which determines if any bottles are missing, a sterilizing station 32, a first filling station 33, a second filling station 34, a cap-cleaning and -feeding station 35, a cap fitting station 36, a cap crimping station 37, and an unloading station 38 at the lower downstream corner 23. The filling stations 33 and 34 load respective basically liquid materials into the bottles B, e.g. crushed fruit and yoghurt, and may correspond to the system shown in above-cited U.S. Pat. No. 4,862,933. The unloading station 38 is a simple conveyor on which the bottles B are set after being released from the conveyor 19 as described below.

The conveyor chain 19 carries a series of the holders 41 each formed with three seats A (FIG. 2) aligned in columns parallel to the direction x and rows extending along lines L perpendicular thereto and spaced in the direction x at a spacing s. The bottles B each have a neck formed with a radially outwardly projecting rim adapted to sit on the top faces of the holders 41. The holders 41 are each formed by two plates set on the conveyor 19 such that as the conveyor chain 19 goes around the corners 22 and 23 each holder 41 will open up its seats A and allow bottles B to be loaded in. Similarly at the downstream corner 23 the holders 41 open so the bottles B are set down on the unloading conveyor 38.

According to the invention a shaft 42 extends between the units 33 and 34 horizontally transverse to the directions x and z. It is journaled at a bearing 43 in the frame 11 and has an inner end 48 projecting through an inner wall 44 of the hollow frame 11 into an internal sterile chamber 45. A seal 46 comprised of a gland 47 prevents leakage between the shaft 42 and the wall 44.

The inner end 48 of the shaft 42 carries a metering wheel 49 having teeth 50 that engage between rollers 51 extending between inner and outer cheeks 52 and 53 of one of the roller chains 54 of the conveyor 19. Pins 55 interconnect the cheek plates 52 and 53 and carry the rollers 51. The chain 54 rides at least adjacent the metering wheel 49 on a guide rail 56 fixed in the frame 11. The holders 41 are each mounted on the inner cheek plates 53 of two such chains of which only one is shown here. The location on the frame 11 of this position-detecting system 59 is as close as possible to the machines that need to be most accurately aligned with the containers B, here the fillers 33 and 34.

The shaft 42 has an outer end 57 carrying a hub 58 in turn carrying a switching element comprised mainly of a disk 61 having on its periphery at least one switching element 60, e.g. a permanent magnet. Fixed on the frame 11 adjacent the periphery of the disk 61 carrying the magnet 60 is a proximity sensor 62 comprising a noncontacting inductor 63 carried on a bracket 64 and connected via a line 65 to a controller 66 in turn connected to the motor M.

The diameter T of the wheel 49 is such relative to that of the disk 61 that each time a row of the seats A is at a predetermined position relative to the shaft 42, the parts 60 and 63 align and a signal or pulse is sent via the line 65 to the controller 66. In other words, the spacing s is equal to the effective circumference of the wheel 19. The controller 66 then stops the motor M and starts the sterilizer unit 32, filler units 33 and 34, and capping units 35 and 36. The motor M is restarted again once all the machines 32 through 37 have completed their jobs. In this manner the chain advance is controlled in direct relationship with the actual position of the conveyor 19 so that perfect positioning of the seats A in the units 32 through 37 is ensured. Normally the pulse is sent out on juxtaposition of the sensor parts 60 and 63 slightly before the seats A are in perfect position since the inertia of the system is considerable and it takes the motor M a little time to make any speed and/or position compensations that are required. This compensation for inertia can be done by offsetting the outer disk 61 angularly relative to the inner wheel 49. The diameter T is such that one full revolution of the wheel 49 is executed for each movement of the conveyor 19 between succeeding positions.

Figure 2:
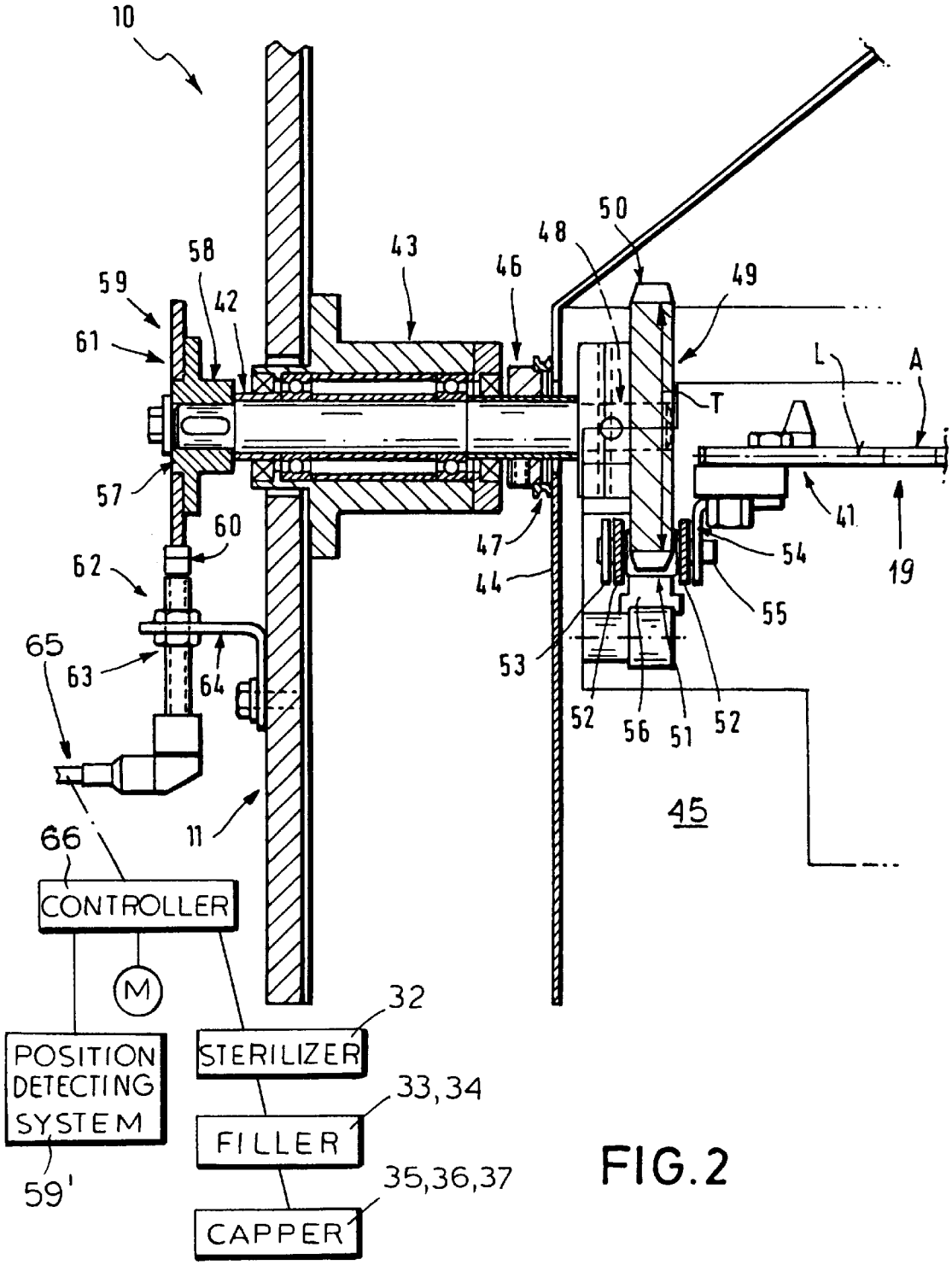
FIG. 2 is a larger-scale cross section through a detail of the machine of in FIG. 1.

FIG. 2 also indicates that the controller 66 can be connected to a second position detector 59' identical to the detector 59 and having a shaft (unillustrated) coaxial with the shaft 42, but meshing with the other chain 54 (unillustrated) on the opposite ends of the holder plates 41 therefrom. Both signals are fed simultaneously to the controller 66 which shuts down the equipment if they are not received within a predetermined time of each other. If they are offset, that indicates the chains 54 flanking the holders 41 are not in synchronism which is usually an indication of some trouble like something jamming on one side of the conveyor 19.

I claim:

1. An apparatus for filling containers, the apparatus comprising:

a frame carrying a plurality of sprockets;

an endless conveyor chain on the frame having between two of the sprockets a straight treatment stretch;

a succession of holders secured to the chain and each formed with a transverse row of seats adapted to hold respective containers;

means including respective machines carried on the frame and spaced apart along the stretch for cleaning, filling, and capping containers in the seats;

drive means connected to one of the sprockets for advancing the chain and moving the containers in the seats in steps past the machines;

a metering shaft journaled in the frame and having a pair of ends;

a metering wheel carried on one of the metering-shaft ends and meshing near one of the machines with the chain such that as the chain is advanced the wheel is synchronously rotated;

a disk carried on the other end of the metering shaft;

a fixed sensor element on the frame;

a movable sensor element mounted on the disk and orbitable on rotation of the wheel past the fixed sensor element to generate an output; and control means connected between the fixed sensor element and the drive means for receiving the output and positioning the seats with respect to the machines.

2. The container-filling apparatus defined in claim 1 wherein the angular position of the movable sensor element is adjustable on the disk.

3. The container-filling apparatus defined in claim 1 wherein the movable sensor element is mounted on an outer periphery of the disk.

4. The container-filling apparatus defined in claim 3 wherein the movable sensor element is set on the disk at an angular position such that the sensor elements come into closest proximity with each other at a time when the holders are immediately upstream of a desired stopping position, whereby inertia of the chain is compensated for by the angular offset of the movable sensor element.

5. The container-filling apparatus defined in claim 1 wherein the wheel has teeth meshing with the conveyor chain.

6. The container-filling apparatus defined in claim 5 wherein an effective circumference of the wheel at the teeth is equal to a longitudinal spacing between succeeding holders on the conveyor chain.

7. The container-filling apparatus defined in claim 1 further comprising a second conveyor chain transversely offset from and extending parallel to the first-mentioned chain and moved synchronously by the drive means with the first chain, the metering wheel meshing with the first chain;

a second metering wheel journaled in the frame and meshing across from the first-mentioned metering wheel with the second conveyor chain such that as the chains are advanced the second wheel is synchronously rotated;

a second fixed sensor element on the frame;

a second movable sensor element fixed relative to the second wheel and orbitable on rotation of the second wheel past the second fixed sensor element to generate an output.

8. The container-filling apparatus defined in claim 7 wherein the control means is connected to both of the fixed sensors and including means for measuring how much time elapses between generation of the outputs by the fixed sensor elements.

9. The container-filling apparatus defined in claim 8 wherein the control means includes means for stopping the chains when the outputs of the fixed sensors are not generated within a predetermined time of each other.

* * * * *